US006745785B2

(12) United States Patent
Kotovsky

(10) Patent No.: US 6,745,785 B2
(45) Date of Patent: Jun. 8, 2004

(54) CANE

(76) Inventor: Irwin Kotovsky, 3941 California Ave., Pittsburgh, PA (US) 15212

( * ) Notice: Subject to any disclaimer, the term of this patent is extended or adjusted under 35 U.S.C. 154(b) by 0 days.

(21) Appl. No.: 10/052,653

(22) Filed: Jan. 18, 2002

(65) Prior Publication Data

US 2003/0136435 A1 Jul. 24, 2003

(51) Int. Cl.[7] ..... A45B 9/00
(52) U.S. Cl. ..... 135/65; 135/65
(58) Field of Search ..... 135/65, 66, 16, 135/17; 280/816, 819; 206/427, 217; 220/4.26, 4.27

(56) References Cited

U.S. PATENT DOCUMENTS

| | | | | |
|---|---|---|---|---|
| 26,721 | A | | 1/1860 | Trowbridge |
| 139,020 | A | * | 5/1873 | Osborn |
| 255,299 | A | * | 3/1882 | Keam |
| 2,326,414 | A | * | 8/1943 | Thompson |
| 3,263,806 | A | * | 8/1966 | Ring |
| 3,443,820 | A | * | 5/1969 | Baker |
| 3,561,782 | A | * | 2/1971 | Tyrack |
| 4,143,764 | A | * | 3/1979 | Mass |
| 4,228,908 | A | * | 10/1980 | Teweeton |
| 4,229,015 | A | * | 10/1980 | Rammsey et al. |
| 4,351,348 | A | * | 9/1982 | Axton ..... 135/66 |
| 4,407,318 | A | * | 10/1983 | Stuever |
| 4,598,832 | A | * | 7/1986 | Alonso |
| 5,417,327 | A | * | 5/1995 | Saumure ..... 206/427 |
| 6,539,965 | B1 | * | 4/2003 | White |

FOREIGN PATENT DOCUMENTS

| | | | | |
|---|---|---|---|---|
| DE | 67 552 C | | 3/1893 | |
| DE | 311 240 C | | 2/1917 | |
| DE | 35 01 867 A1 | * | 7/1986 | ..... A63C/11/22 |
| FR | 568 202 A | | 3/1924 | |
| FR | 2 747 781 | * | 10/1997 | ..... G01N/1/10 |
| GB | 183 622 A | | 8/1922 | |

* cited by examiner

*Primary Examiner*—Robert Canfield
(74) *Attorney, Agent, or Firm*—Ansel M. Schwartz

(57) ABSTRACT

A cane includes a top. The cane includes a shaft having a first compartment, a second compartment and at least a third compartment. The top is connected to the shaft. The cane includes a first flask for holding fluid and removably disposed in the first compartment. The cane includes a second flask for holding fluid and removably disposed in the second compartment. The cane includes at least a third flask for holding fluid and removably disposed in the third compartment. A method for storing materials in a cane. A method of forming a cane.

12 Claims, 12 Drawing Sheets

CANE

FIELD OF THE INVENTION

The present invention is related to a cane which carries flasks. More specifically, the present invention is related to a cane which carries flasks for holding liquids and for serving as glasses.

BACKGROUND OF THE INVENTION

Aficionados of fine wines and liquors often find themselves in locations lacking in such drink. One common solution to this problem is the use of a metal flask that is carried in a shirt or coat pocket. This has the limitation of carrying only one type of drink. What is desirable is to have a choice of drinks and glasses for more than one person to share in the drinking.

SUMMARY OF THE INVENTION

The present invention pertains to a cane. The cane comprises a top. The cane comprises a shaft having a first compartment, a second compartment and at least a third compartment. The top is connected to the shaft. The cane comprises a first flask for holding fluid and removably disposed in the first compartment. The cane comprises a second flask for holding fluid and removably disposed in the second compartment. The cane comprises at least a third flask for holding fluid and removably disposed in the third compartment.

The present invention pertains to a method for storing materials. The method comprises the steps of placing a first flask for holding material into a first compartment of a shaft of a cane. There is the step of placing a second flask for holding material into a second compartment of the shaft of the cane. There is the step of placing a third flask into a third compartment of the shaft of the cane. There is the step of connecting a cap of the cane onto the shaft of the cane.

The present invention pertains to a method of forming a cane. The method comprises the steps of drilling a first compartment out of a first portion of a shaft from a first end of the first portion. There is the step of drilling a second compartment out of the first portion of the shaft from a second end of the first portion. There is the step of drilling a third compartment out of a second portion of the shaft from a first end of the second portion.

The present invention pertains to an apparatus for carrying a fluid. The apparatus comprises at least one flask which holds the fluid. The apparatus comprises a case which holds the flask. The apparatus comprises means for storing information. The storing means disposed in the case.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1A:
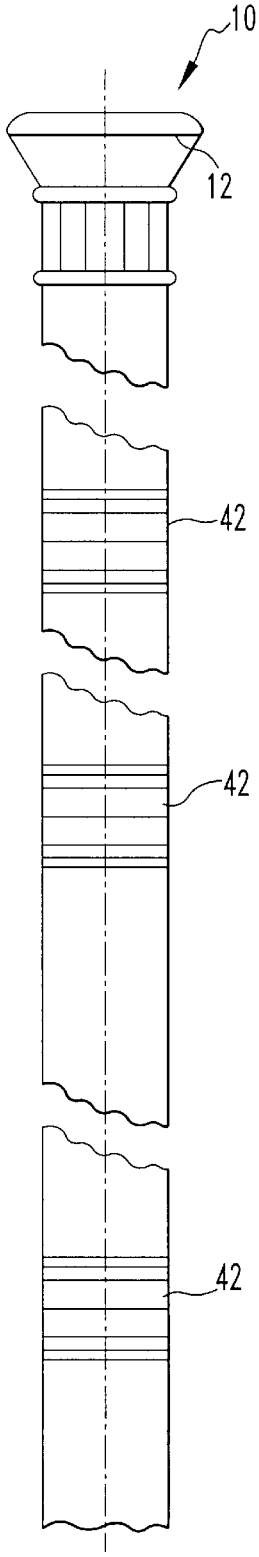
FIG. 1*a* is a side view of a cane with four compartments.
Figure 2:
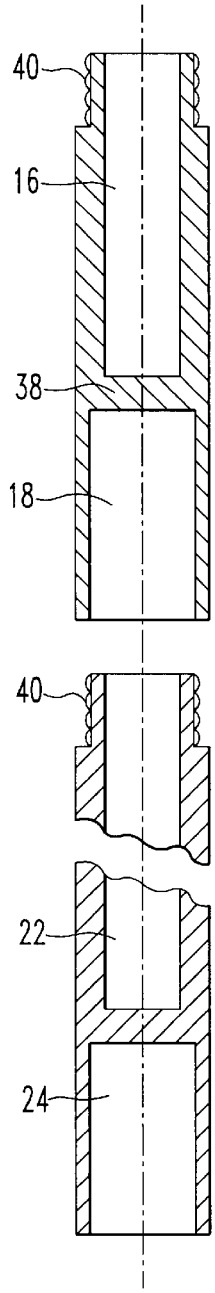
FIG. 2 is a cut-away side view of a cane with four compartments.
Figure 1B:
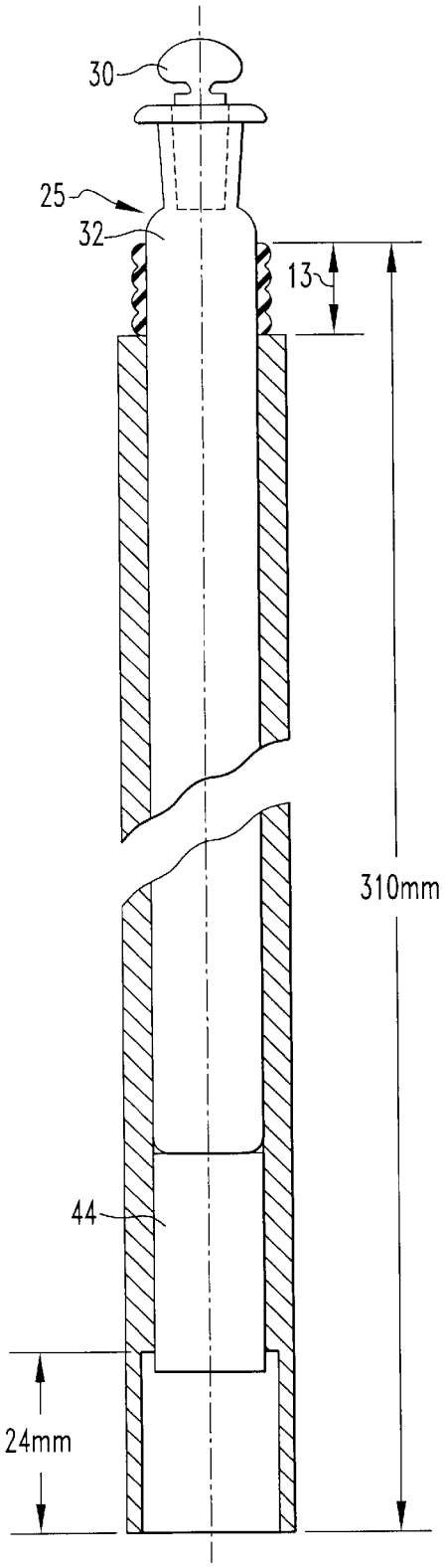
FIGS. 1*b* and 1*c* are cut away side views of a cane with a flask.
Figure 1C:
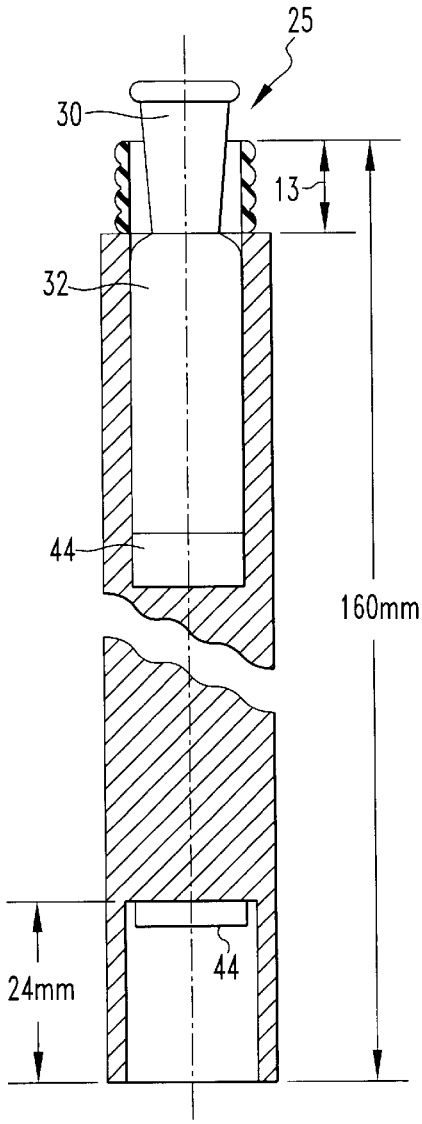
Figure 3A:
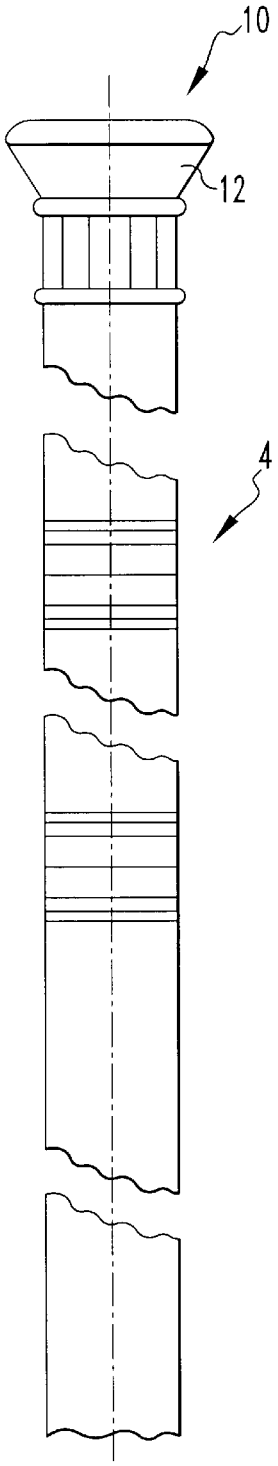
FIG. 3*a* is a side view of a cane with three compartments.
Figure 4:
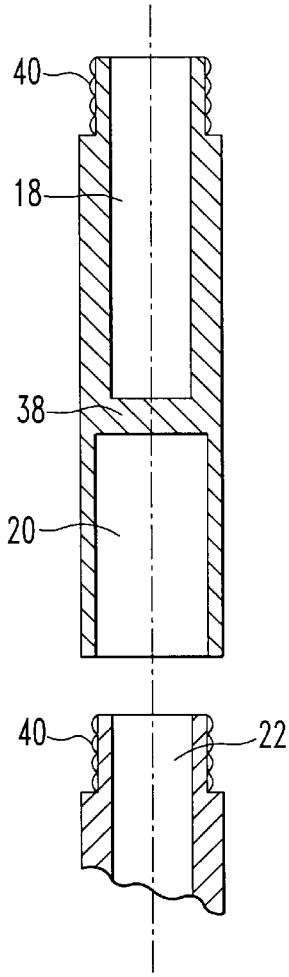
FIG. 4 is a cut away side view of the cane with three compartments.
Figure 3B:
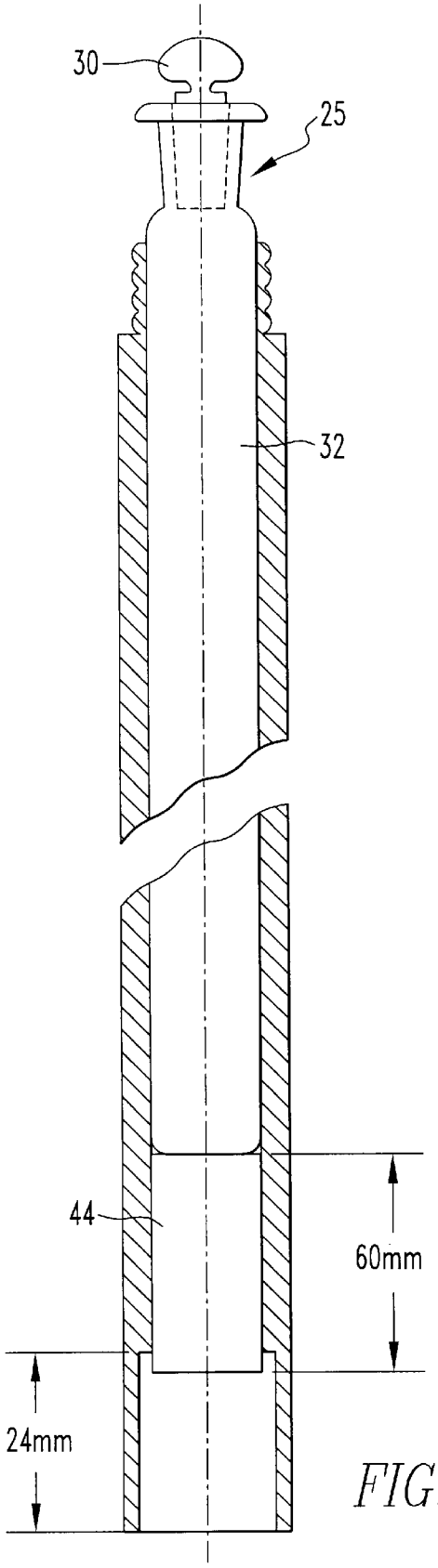
FIG. 3*b* is a cut-away side view of a cane with a flask.
Figure 6:
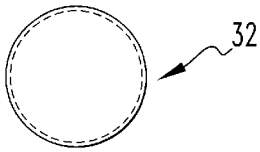
FIG. 6 is a top view of a flask without its cap.
Figure 7:
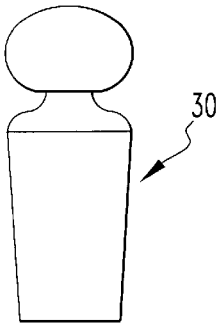
FIG. 7 is a side view of a cap.
Figure 5:
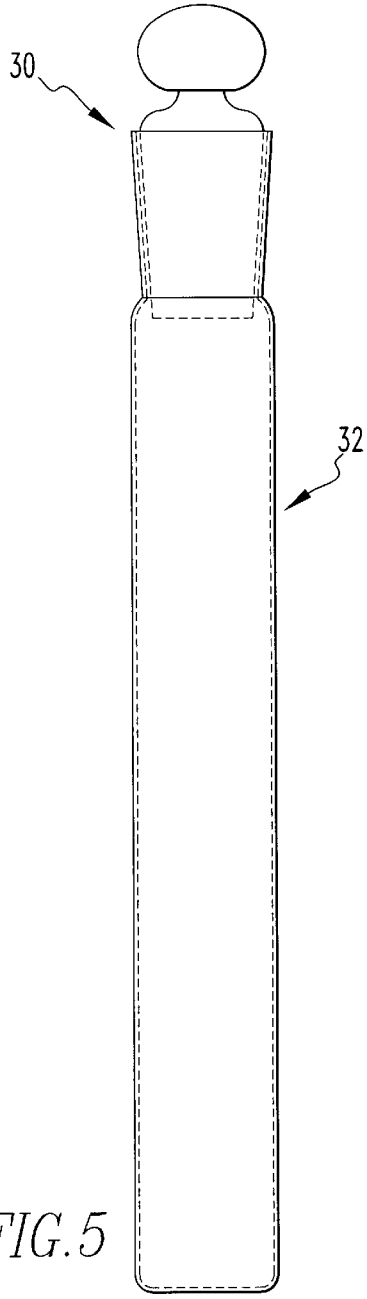
FIG. 5 is a side view of a flask.
Figure 8:
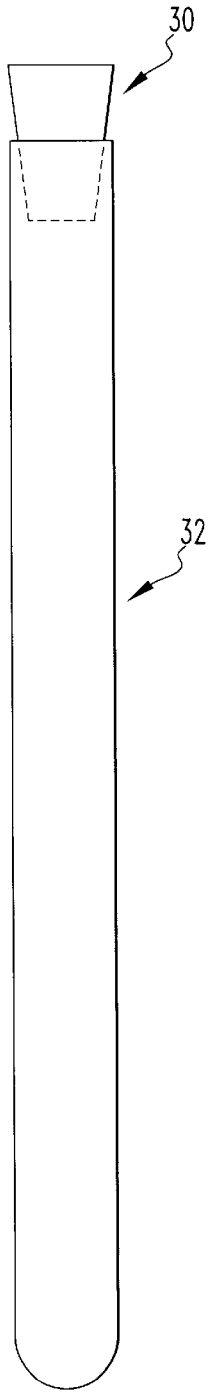
FIG. 8 is a side view of a flask with a cork as the cap.
Figure 9:
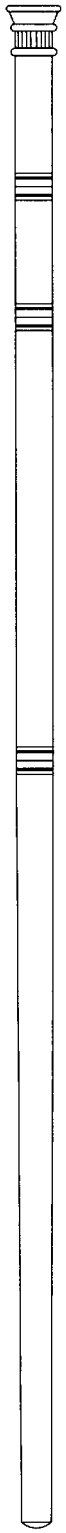
FIG. 9 is a view of a cane.
Figure 10:
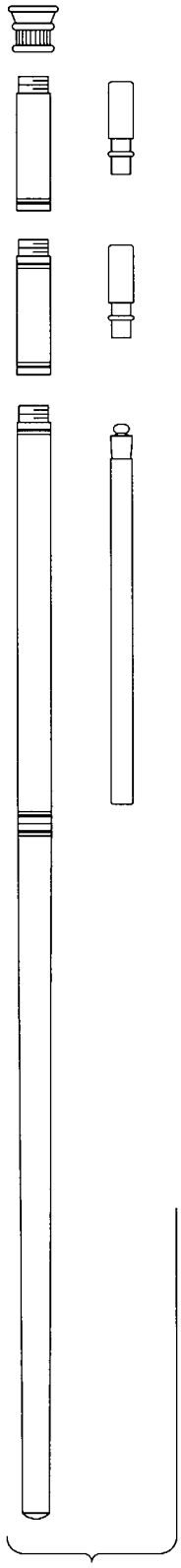
FIG. 10 is a view of a disassembled cane.
Figure 11:
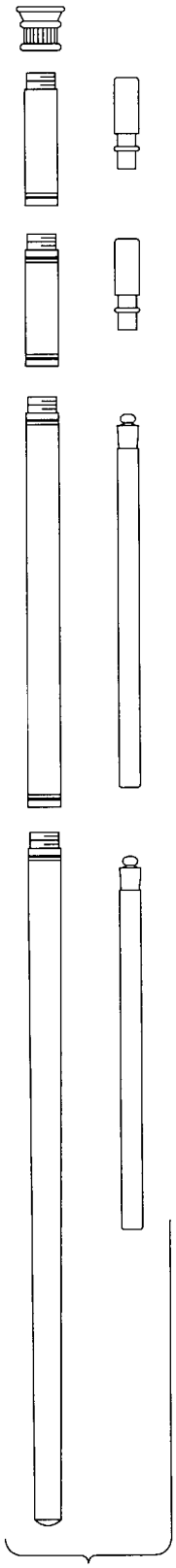
FIG. 11 is a view of another embodiment of a disassembled cane.
Figure 12:
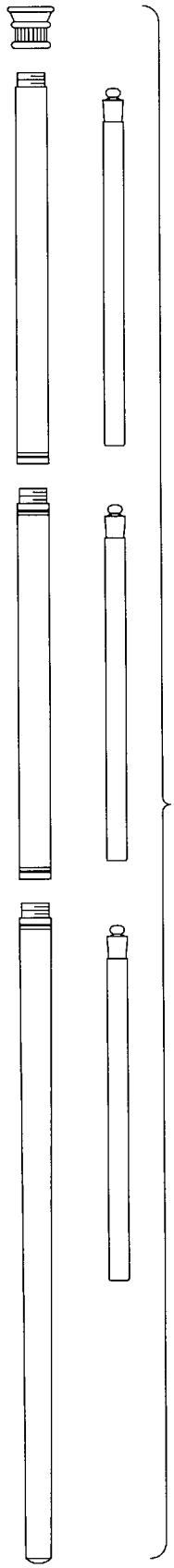
FIG. 12 is a view of another embodiment of a disassembled cane.

Referring now to the drawings wherein like reference numerals refer to similar or identical parts throughout the several views, and more specifically to FIGS. 1*a*–4 thereof, there is shown a cane 10. The cane 10 comprises a top 12. The cane 10 comprises a shaft 14 having a first compartment 18, a second compartment 20 and at least a third compartment 22. Preferably, there can be a fourth compartment 24. The top 12 is connected to the shaft 14. The cane 10 comprises a first flask 25, as shown in FIGS. 5–8, for holding fluid and removably disposed in the first compartment 18. The cane 10 comprises a second flask 26 for holding fluid and removably disposed in the second compartment 20. The cane 10 comprises at least a third flask 28 for holding fluid and removably disposed in the third compartment 22. Preferably, there can be a fourth flask for holding fluid and removably disposed in the fourth compartment 24.

Preferably, each flask comprises a cap 30 and a base 32 in which fluid is held and on which the cap 30 fits. The shaft 14 preferably comprises a first portion 34 and a second portion 36 which removably connects with the first portion 34. The first portion 34 has the first and second compartments 18, 20, and the second portion 36 has at least the third compartment 22. Alternatively, there can be a third portion, and a flask is then disposed in each portion.

Preferably, the shaft 14 is cylindrically shaped. Each compartment preferably is cylindrically shaped and each base 32 is cylindrically shaped. Preferably, the shaft 14 is made of wood, metal or plastic. Each flask is preferably made of glass, plastic or metal. If desired, two of the flasks can be made longer to hold fluid, and two of the flasks smaller, to act as glasses.

Preferably, each compartment is separated by a spacer 38. The first portion 34 and the second portion 36 preferably have threads 40 which engage to hold the first portion 34 and the second portion 36 together.

Preferably, the top 12 and the first portion 34 have threads 40 which engage to hold the top 12 and the first portion 34 together. The cap 30 can screw onto the base 32. Preferably, the cap 30 forms a friction fit with the base 32.

The present invention pertains to a cane 10. The cane 10 comprises a top 12. The cane 10 comprises a shaft 14 having a compartment 16. The cane 10 comprises a first flask 25 for holding fluid and removably disposed in the compartment 16. The cane 10 comprises a second flask 26 for holding fluid and removably disposed in the compartment 16. The cane 10 comprises at least a third flask 28 for holding fluid and removably disposed in the compartment 16.

The present invention pertains to a method for storing materials. The method comprises the steps of placing a first flask 25 for holding material into a first compartment 18 of a shaft 14 of a cane 10. There is the step of placing a second flask 26 for holding material into a second compartment 20 of the shaft 14 of the cane 10. There is the step of placing a third flask 28 into a third compartment 22 of the shaft 14 of the cane 10. There is the step of connecting a cap 30 of the cane 10 onto the shaft 14 of the cane 10.

The method preferably includes the step of connecting a first portion 34 of the cane 10 having the first and second compartments 18, 20 with a second portion 36 of the cane 10 having at least the third compartment 22. Preferably the method includes the steps of filling a base 32 of each flask with a desired material and placing a cap 30 and each flask.

The present invention pertains to a method of forming a cane 10. The method comprises the steps of drilling a first compartment 18 out of a first portion 34 of a shaft 14 from a first end of the first portion 34. There is the step of drilling a second compartment 20 out of the first portion 34 of the shaft 14 from a second end of the first portion 34. There is the step of drilling a third compartment 22 out of a second portion 36 of the shaft 14 from a first end of the second portion 36.

In the operation of the invention, a shaft 14 made out of wood is first cut in half to form a first portion 34 and a second portion 36. The shaft 14 is the length of a typical cane 10, and is commonly between 3–5 ft. A first compartment 18 is drilled out of a first end of the first portion 34 of the shaft 14, and a second compartment 20 is drilled out of a second end of the first portion 34 of the shaft 14. A spacer 38 is disposed between the first compartment 18 and the second compartment 20. Similarly, a third compartment 22 is drilled out of a first end of the second portion 36 of the shaft 14. If desired, a fourth compartment 24 can be drilled out of a second end of the second portion 36 of the shaft 14. Alternatively, a single compartment 16 can be formed by drilling through the first portion 34 of the shaft 14, and into the second portion 36 of the shaft 14.

Threads 40 are formed at the second end of the first portion 34 and the first end of the second portion 36 so that the first portion 34 and second portion 36 can be screwed together to form the shaft 14. The advantage of having the shaft 14 being able to separate into the first portion 34 and the second portion 36 is that the shaft 14 can be broken down into the first portion 34 and second portion 36 when it is not being used, and placed in a caring case or stored. Additionally, the first end of the first portion 34 can be threaded to receive a top 12 for the shaft 14 to close the first compartment 18. The top 12 can be made of gold and embroidered. Similarly, there can be a connector 42 made out of gold which is embroidered that is threaded to receive the second end of the first portion 34 and the first end of the second portion 36, instead of the first portion 34 and second portion 36 mating directly together. The connector 42 can be solid to act as a closure for the second compartment 20 and the third compartment 22.

The base 32 of the first flask 25 is filled with a desired material, such as scotch, and the cap 30 of the first flask 25 is placed on the base 32 of the first flask 25. Similarly, this is repeated for the second flask 26 and the third flask 28, where gin, or vodka, or a desired wine, or soda, or other type of drink, or a powdered substance can be placed into the respective base 32 of the respective flask. All of the flasks can have the same material, or there can be different materials in each flask. Once the cap 30 is secured to the base 32 of the first flask 25, the first flask 25 is inserted into the first compartment 18 of the shaft 14, and the top 12 is screwed onto the first end of the first compartment 18 to close the first compartment 18 and hold the first flask 25 in the first compartment 18. Similarly, when the second base 32 is filled, the cap 30 is closed to the second base 32, the second flask 26 is inserted into the second compartment 20 and the second end of the first portion 34 is then screwed onto the connector 42 so that the second compartment 20 is closed and the second flask 26 is held in place and in second compartment 20.

After the third flask 28 is filled and closed, it is placed in the third compartment 22. The first end of the second portion 36 is then screwed onto the connector 42, which is already screwed onto the first portion 34, to close the second compartment 20. In this way, the cane 10 is formed with three filled flasks. If a fourth flask is desired, it can be included in a fourth compartment 24 in the second portion 36. Alternatively, if a single compartment 16 is used that extends through the first and second portions 34, 36, then each of the flasks are loaded into the only compartment 16, without any spacer 38 between the flasks, and the first and second portions 34, 36 and screwed together. The shaft 14 can be one continuous piece, or be more than two pieces, in which case it would be formed as described above except with additional portions.

Tubular separators 44, made out of foam, cork or rubber, are threaded or preferably glued inside each of the bottom of a portion which mates with another portion having a flask extending from it. With the separator 44 present, when the portions are threaded together, the separators 44 will compress to take up the tolerance between the top of the cap 30 and interior of the portion above to eliminate rattling of the flask and to provide enough pressure so that the cap 30 is tightly sealed and seated in the base 32 to eliminate fluid seepage. By eliminating the rattling, it essentially eliminates the cracking of the flask, or the cap 30 loosening from the base 32.

The individual portions can be built to any length to suit the user. Taller users will have the individual portions together be longer than the length of the individual portions connected together for shorter users. Preferably, each portion of the cane 10 is of the same overall length when it is side by side and furnished with a top 12. This makes the use of a carrying case having slots in packing material in the case of the same length to facilitate storage of the individual portions in the case, and possible use to carry the cane 10 while traveling.

Figure 13:
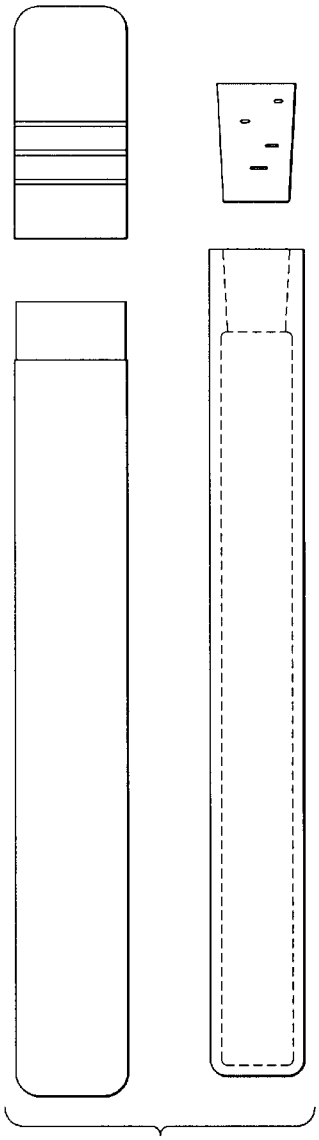
FIGS. 13, 14 and 15 are views of various embodiments of flasks with holders.
Figure 14:
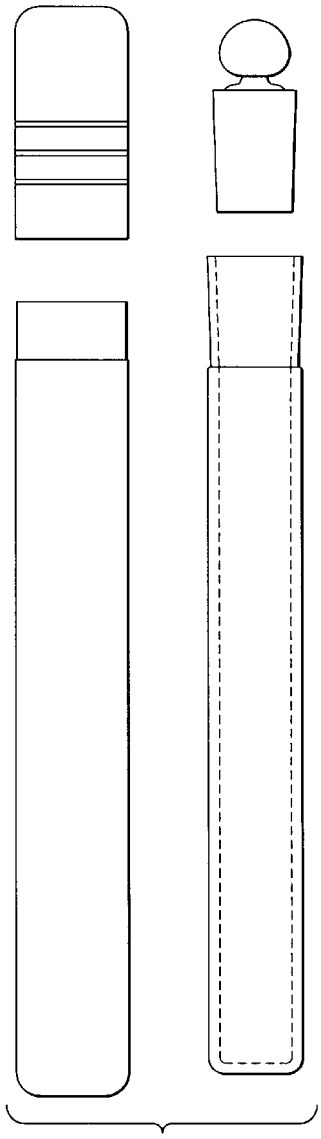
Figure 15:
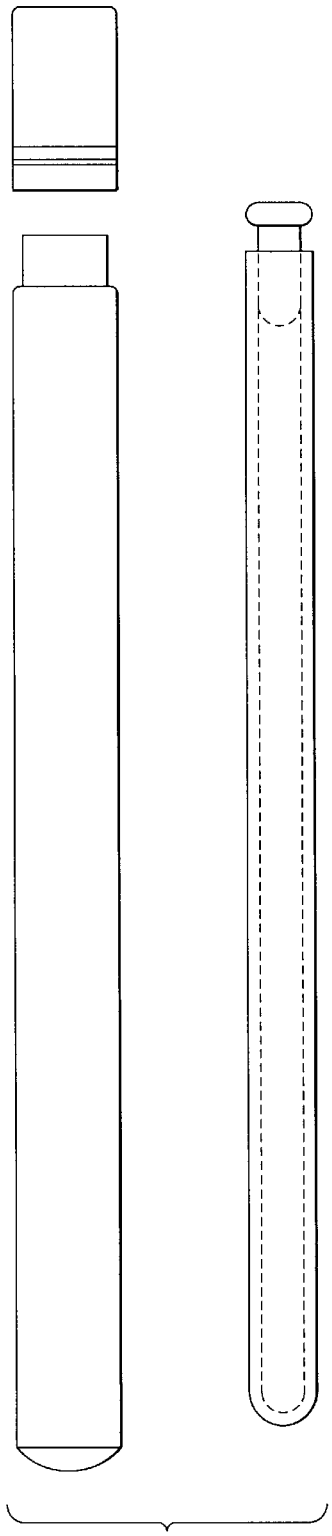
Figure 16:
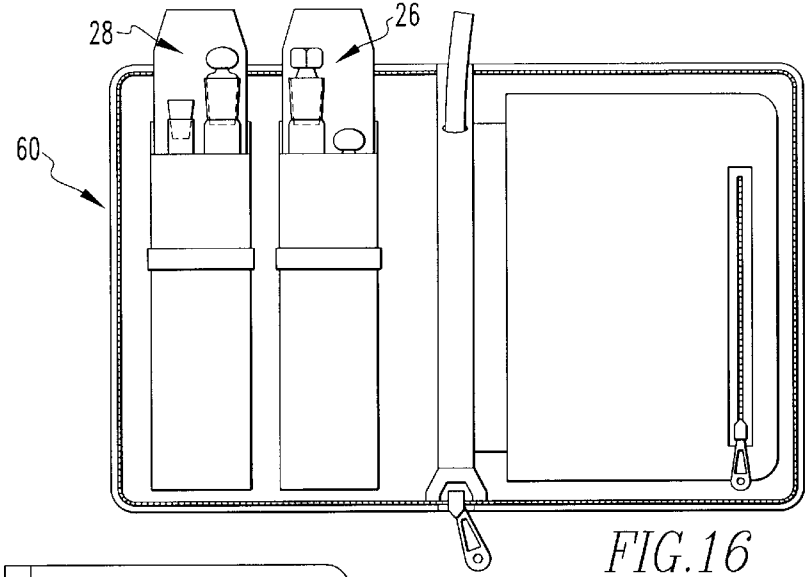
FIGS. 16–19 are schematic representations of another embodiment of an apparatus for carrying fluid.

FIGS. 13, 14 and 15 show holders 55 for flasks. These holders are of a size that fit into a shirt pocket, and are very similar to cigar holders. A holder can hold 1–4 flasks depending on how wide they are made. The flask is inserted into the body of the holder and a lid of the holder is then placed on the body to close the body and hold the flask.

FIGS. 20–24 show another embodiment of a holder 55. The holder 55 has a first flap 70 and a second flap 72 which fold onto a center portion 73. The center portion 73 has loops 76 in which the flasks fit and are held by the holder 55.

The holder 46 can have a flap 48 which attaches to the body 50 of the holder 46 through a loop 52 on the body 50 of the holder 46, or by a snap 54 on the flap 48 which snaps to the front of the body 50 of the holder 46, as shown in FIGS. 25–29. The holder 46 can have a clip 56 to attach to a belt of the user, or fit to the shirt pocket of the user. The holder 46 can be comprised of three individual tubes 58 that are connected together.

The present invention pertains to an apparatus 60 for carrying a fluid, as shown in FIGS. 16–19. The apparatus 60 comprises at least one flask 25 which holds the fluid. The apparatus 60 comprises a case 64 which holds the flask 25. The apparatus 60 comprises means 66 for storing information. The storing means 66 disposed in the case 64. Preferably, the case 64 includes closing means 68 for closing the case 64.

Figure 17:
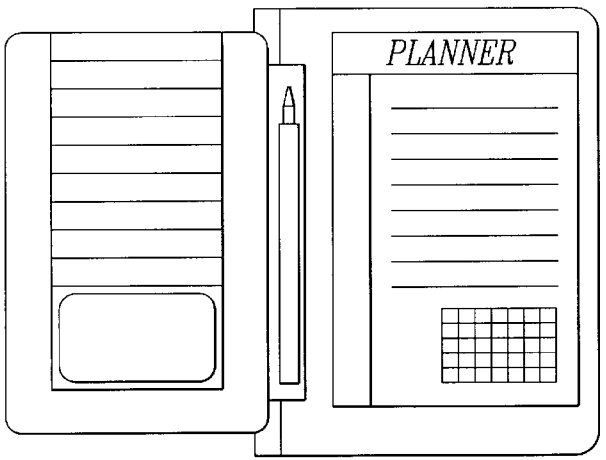
Figure 18:
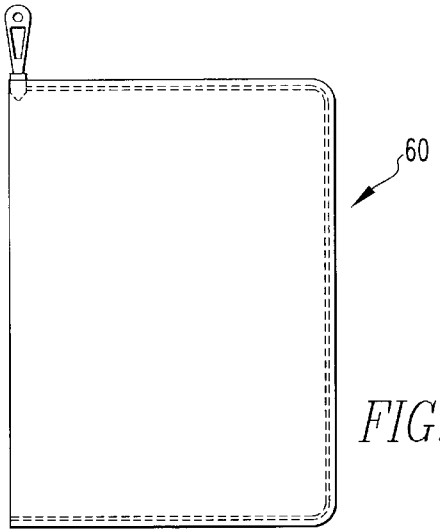
Figure 19:
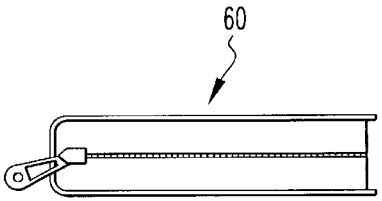
Figure 20:
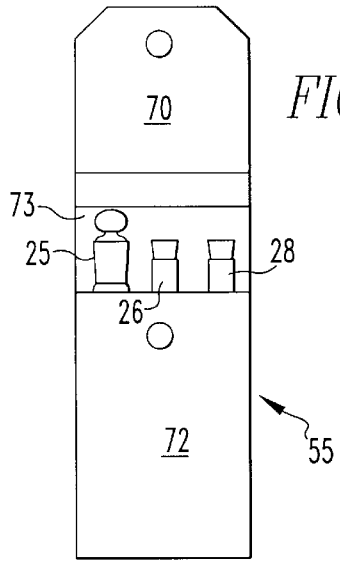
FIGS. 20–24 are schematic representations of another embodiment of an apparatus for carrying fluid.
Figure 21:
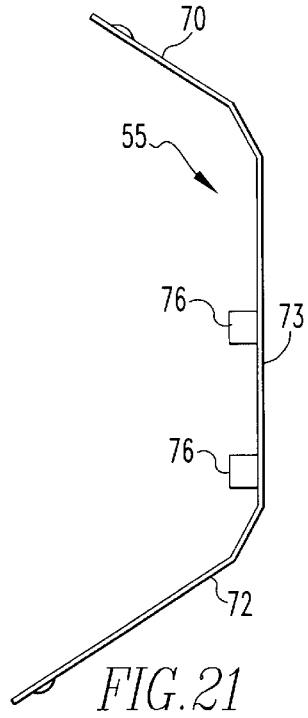
Figure 23:
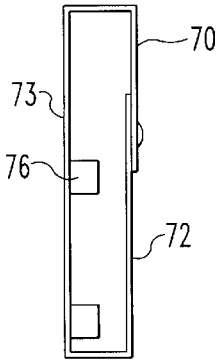
Figure 22:
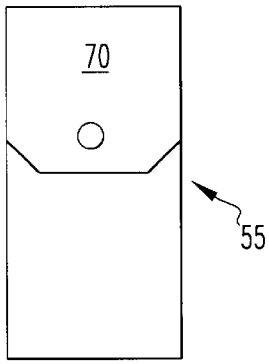
Figure 24:
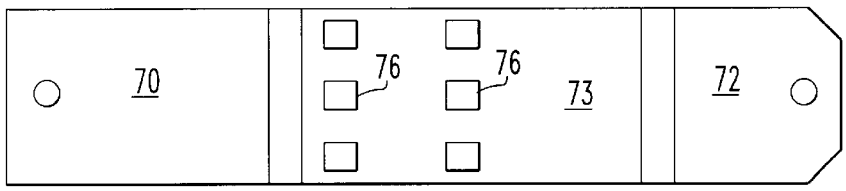
Figure 28:
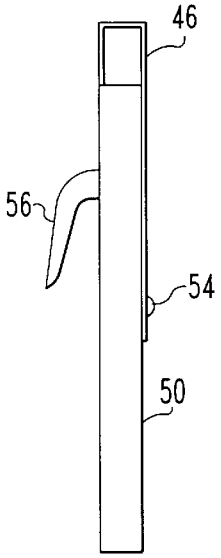
FIGS. 25–29 are schematic representations of another embodiment of an apparatus for carrying fluid.
Figure 25:
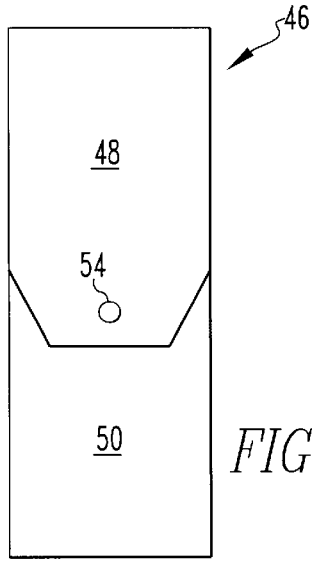
Figure 26:
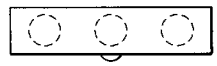
Figure 29:
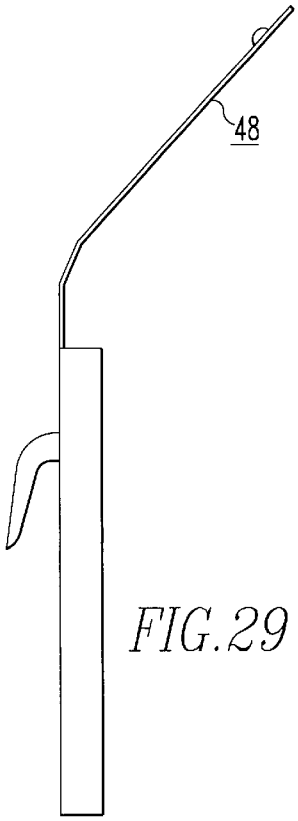
Figure 27:
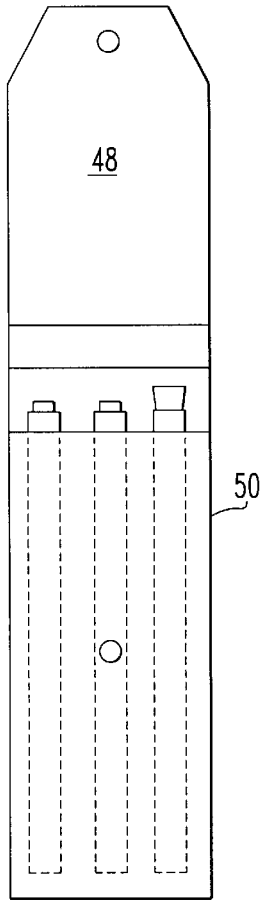

The closing means 68 can include a zipper used to close the case 64 when a first flap 70 and a second flap 72 of the case 64 are folded together. The flask 25 can be held on the first flap 70 and the storing means 66 can be held on the second flap 72. The zipper is closed or zipped up when the first flap 70 and second flap 72 are folded together. Alternatively, the closing means 68 can includes a button/snap mechanism, with the button disposed on one flap of the case and the snap disposed on the other flap of the case so that when the first and second flaps of the case are closed together. The button can be snapped to the snap to close it. The storing means 66 can be a PDA or a pad of paper. The case can include an intermediate page and a pen, as shown in FIG. 17.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A cane which is 3–5 feet long comprising:

a top;

a shaft having a first compartment, a second compartment and at least a third compartment, the top connected to the shaft, a first flask for holding fluid and removably disposed in the first compartment;

a second flask for holding fluid and removably disposed in the second compartment; and at least a third flask for holding fluid and removably disposed in the third compartment, wherein each flask comprises a cap and a base in which fluid is held and on which the cap fits to and from which the cap extends, the shaft comprises a first portion and a second portion which removably connects with the first portion, the first portion having the first and second compartment, and the second portion having at least the third compartment, the top, the first portion and the second portion together being 3–5 feet long.

2. A cane as described in claim 1 wherein the shaft is cylindrically shaped.

3. A cane as described in claim 2 wherein each compartment is cylindrically shaped and each base is cylindrically shaped.

4. A cane as described and claim 3 wherein the shaft is made of wood, metal or plastic.

5. A cane as described in claim 4 wherein each flask is made of glass, plastic or metal.

6. A cane as described in claim 5 wherein each compartment is separated by a spacer.

7. A cane as described in claim 6 wherein the first portion and the second portion have threads which engage to hold the first portion and the second portion together.

8. A cane as described in claim 7 wherein the top and the first portion have threads which engage to hold the top and the first portion together.

9. A cane as described in claim 8 wherein the cap screws onto the base.

10. A cane as described in claim 8 wherein the cap forms a friction fit with the base.

11. A cane as described in claim 7 wherein the first portion has a separator disposed in it which contacts with the second flask in the second compartment with the first portion and second portion are held together to prevent rattling of the second flask.

12. A method for storing materials comprising the steps of:

filling a base of a first flask, second flask and third flask with a desired material and placing a cap on each flask;

placing first flask into a first compartment of a shaft of a cane;

placing second flask into a second compartment of the shaft of the cane;

placing third flask into a third compartment of the shaft of the cane;

connecting a first portion of the cane having the first and second compartments with a second portion of the cane having at least the third compartment; and connecting a cap of the cane onto the shaft of the cane.

* * * * *